United States Patent [19]

Harboe

[11] Patent Number: 4,573,507

[45] Date of Patent: Mar. 4, 1986

[54] DEVICE FOR SPLITTING AND CUTTING OF FIREWOOD

[75] Inventor: Jahn Harboe, Tistedal, Norway

[73] Assignee: Saugbruksforeningen, Halden, Norway

[21] Appl. No.: 651,137

[22] Filed: Sep. 17, 1984

[30] Foreign Application Priority Data

Sep. 16, 1983 [NO] Norway ..... 833345

[51] Int. Cl.[4] ..... B27L 7/00

[52] U.S. Cl. ..... 144/193 A; 144/3 K

[58] Field of Search ..... 144/193 A, 366, 3 K

[56] References Cited

U.S. PATENT DOCUMENTS

| | | | |
|---|---|---|---|
| 2,612,194 | 9/1952 | Ingraham et al. | 144/34 E |
| 4,153,088 | 5/1979 | King et al. | 144/193 A |
| 4,273,171 | 6/1981 | Spaulding, Sr. | 144/193 A |
| 4,398,581 | 8/1983 | Aikins et al. | 144/366 |
| 4,483,379 | 11/1984 | Aikins et al. | 144/366 |

*Primary Examiner*—W. D. Bray
*Assistant Examiner*—Jorji M. Griffin
*Attorney, Agent, or Firm*—Sughrue, Mion, Zinn, Macpeak and Seas

[57] ABSTRACT

Device for splitting and cutting firewood, having a clamping device (3) adapted to be secured to an abutment plate (2) which is displaceable by hydraulic force. A log can be inserted through the clamping device between a guide plate (6) and two angled knives (5), and by activating a hydraulic cylinder (8) it will be forced between the two knives in the clamping device and a fixed vertical knife (1). A horizontal knife (4) may be arranged on the side of the vertical knife such that splitting and cutting are achieved simultaneously. The clamping device (3) is easily removed to use the device only as a splitter whereby the firewood is forced between the abutment plate (2) and the fixed knife (1), whereas the horizontal knives (4) simultaneously split more of the firewood.

1 Claim, 6 Drawing Figures

DEVICE FOR SPLITTING AND CUTTING OF FIREWOOD

BACKGROUND OF THE INVENTION

The invention relates to a device for cutting and slicing firewood.

In the market there are several devices for cutting and splitting firewood as well as some combined devices which simultaneously cut and split. Such a device is described in Norwegian Pat. No. 145,650.

Most of the cutting devices work according to a guillotine principle with rotating knives or knives driven by pistons. These systems, however, have the disadvantage that the firewood has a tendency to be splintered, and furthermore they have a limited capacity.

SUMMARY OF THE INVENTION

The device according to the invention has proved to have none of the disadvantages stated above and additionally has a great capacity as well as large flexibility concerning the dimensions of the logs to be cut and the desired form of splitting. The fundamental thought is that the invention may be used as a splitter, as a cutter, or as a combined cutter and splitter. A substantial purpose also is that the cutting must be achieved without any splitting of the firewood.

DETAILED DESCRIPTION OF THE PREFERRED EMBODIMENTS

Figure 1:
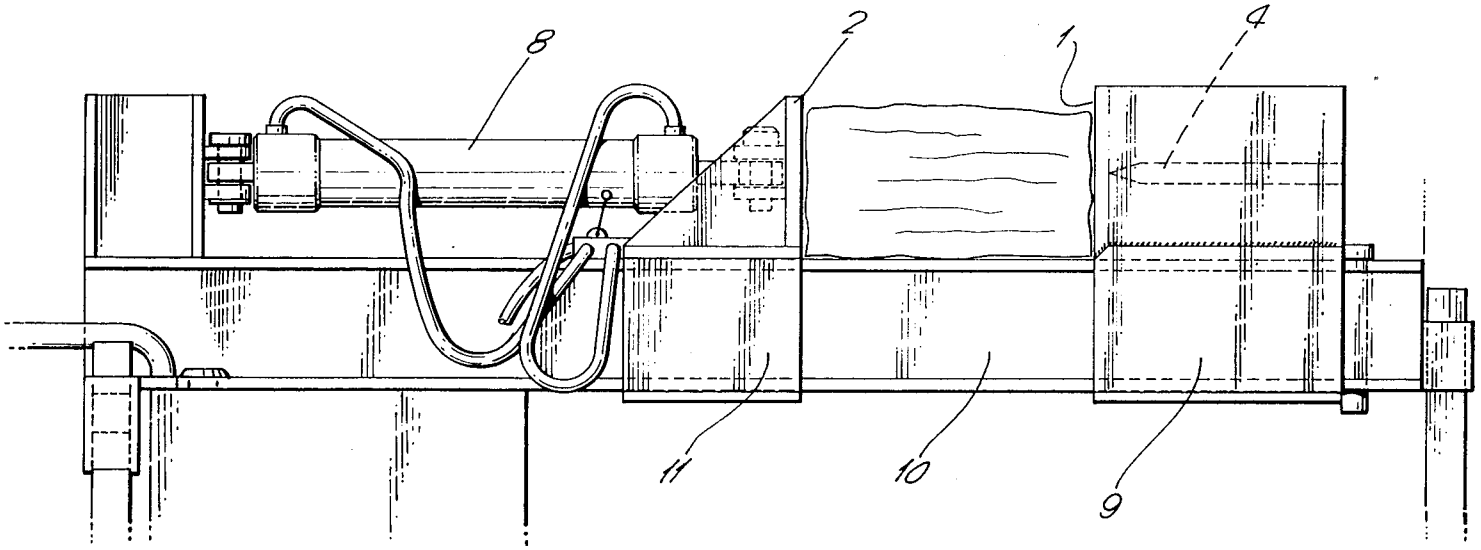
FIG. 1 shows an elevation view of the device, prepared for splitting.
Figure 2:
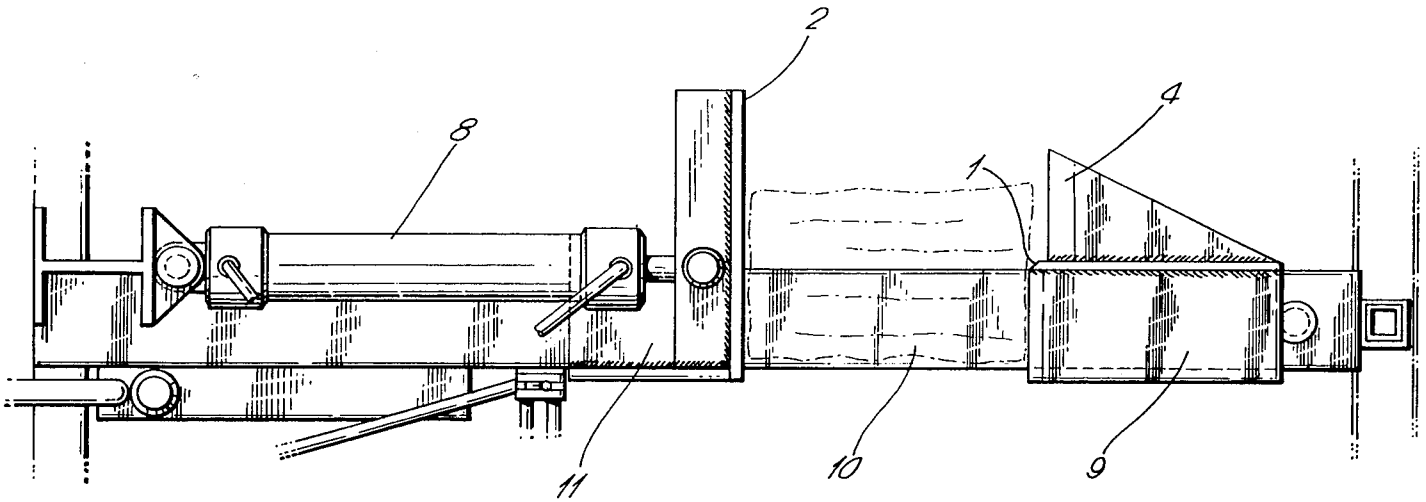
FIG. 2 shows the device of FIG. 1 in a top view.
Figure 3:
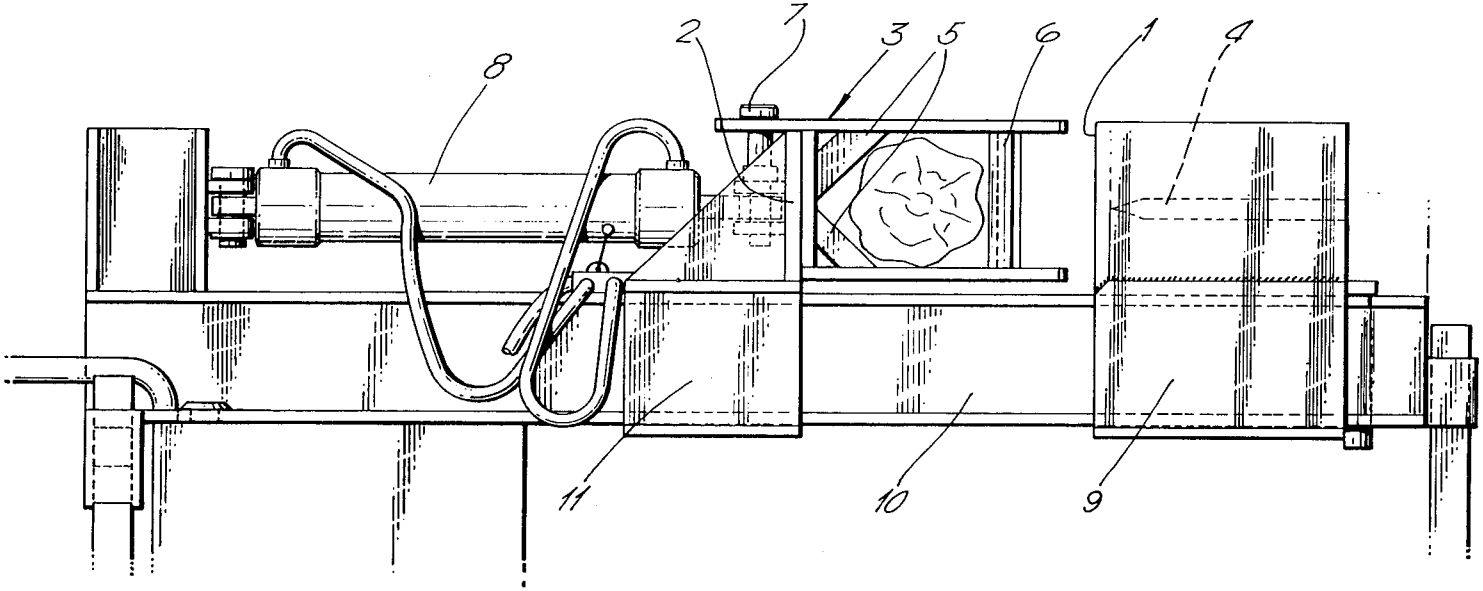
FIG. 3 shows the device in an elevation view, prepared for cutting and splitting.

A vertical knife 1 is secured to a support 9 adapted to be disposed at a suitable location on a horizontal girder 10. The vertical knife 1 may have one or more horizontal knives 4 fixed thereto in such a way that the cutting edges of the knives 4 preferably are arranged behind the edge of the vertical knife 1.

On the same girder 10 a support 11 also is arranged for an abutment plate 2. The abutment plate is connected with a piston rod in a hydraulic cylinder 8 in such a way that the hydraulic cylinder by actuation, displaces the support 11 including the abutment plate 2, against the vertical knife 1.

By introducing firewood between the abutment plate 2 and the knife 1, the cylinder 8 may be actuated in such a way that the abutment plate 2 forces the firewood against the knife 1 and the firewood is thereby split. In advance the support 9 is adjusted corresponding to the length of the firewood.

By means of one or more vertical knives a log may be split several times in the same operation, depending on what is desired.

When using the device as a cutter, a guiding and clamping device 3 is mounted in an easy manner to the abutment plate 2 by a bolt 7 on the clamping device displaced vertically through corresponding guidings arranged on the backside of the abutment plate 2 and thereby is secured in this position. The clamping device 3 is provided with a guide plate 6 as well as two knives 5 arranged at an angle to each other.

By installing the clamping device 3 to the abutment plate 2, the knives 5 are arranged in a wedge form directed against the fixed knife 1. When the hydraulic cylinder 8 is actuated, the abutment plate 2 will bring the clamping device 3 against the fixed knife 1 in such a way that the knives 5 are moved like a scissors against the fixed knife 1.

Figure 4:
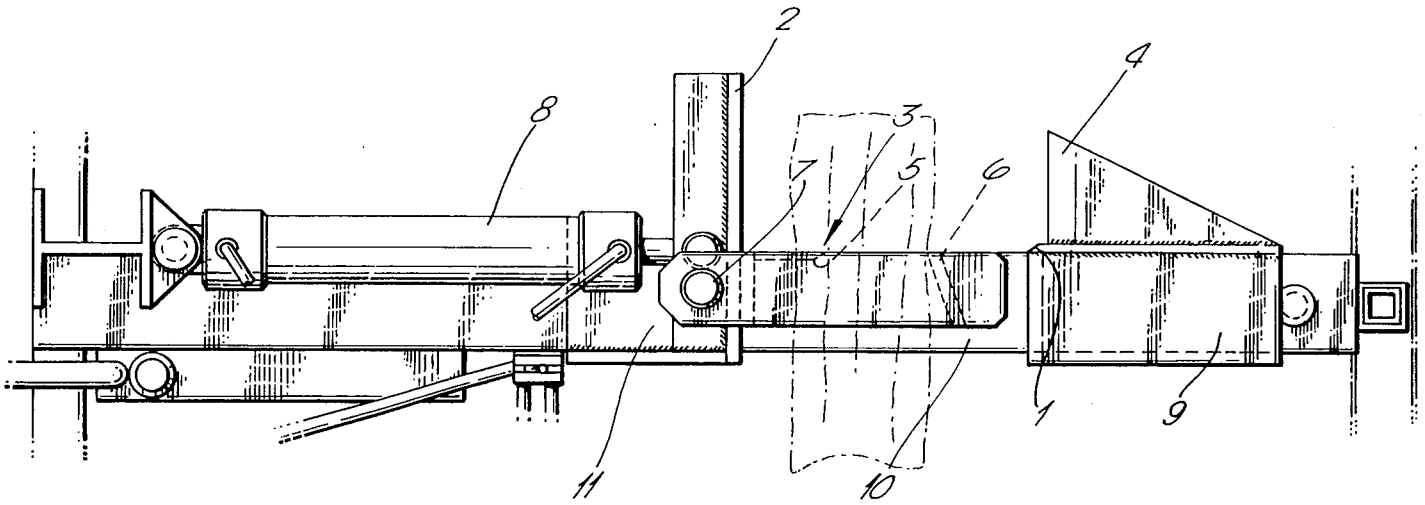
FIG. 4 shows the device of FIG. 3 seen from above.
Figure 5:
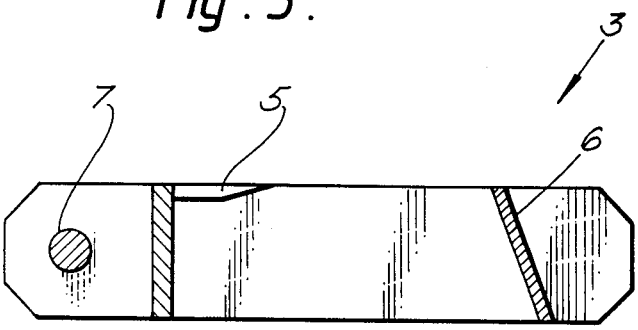
FIG. 5 shows a cross-section through the guiding and clamping device for cutting.
Figure 6:
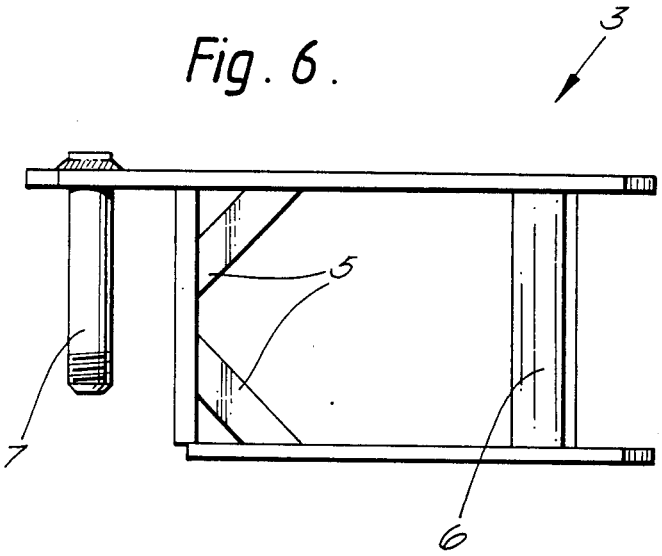
FIG. 6 shows an elevation view of the guiding and clamping device.

During use a log is inserted in the clamping device 3 between the guiding plate 6 and the knives 5, with part of the log projecting to the outside as seen in FIG. 4, corresponding to the length which is desired for the firewood. A suitable supporting device may be arranged on the outside for supporting the log. When the cylinder 8 is activated, the abutment plate 2 moves the knives 5 against the log which is forced against the fixed knife 1 in such a way that a clean cutting of the log is achieved.

Simultaneously to the cutting of the log, the horizontal knife or knives 4 provided on the vertical knife 1, will split the firewood, if such knives are present.

A removable channel, which is not shown in the drawings, is adapted to be fixed to the displaceable part of the device in such a way that the logs to be cut are arranged in the channel and successively displaced into the device for successive cutting operations.

The guide plate 6 is adapted to provide a rough guiding of the log in such a way that the log is arranged correctly with respect to the knives 5. The guide plate 6 is also effective to release logs jammed against the vertical knife 1, as the plate moves the log backwards during the return of the abutment plate, in such a way that the log is kept in the channel.

By a special design of the abutment plate 2 it is achieved that the cut and split firewood is forced against the vertical knife edge when the next length of firewood is cut and split. In this manner it is avoided that cut or split firewood is accumulated.

By means of the removable clamping device 3 very large logs may be used and simultaneously the cut achieved is very clean. Changing the device into a device only for splitting is very quick and easy.

I claim:

1. A device for splitting and cutting firewood, comprising:

(a) an elongate horizontal frame member (10), (b) a vertical knife (1) fixed in relation to the frame member and upstanding therefrom, (c) at least one horizontal knife (4) fixed to a side of the vertical knife and outstanding therefrom, (d) an abutment plate (2) slidably disposed on the frame member and extending transversely thereto, (e) a hydraulic piston and cylinder unit (8) coupled to the abutment plate for displacing said plate toward and away from the vertical and horizontal knives, and (f) a clamping member (3) removably mounted to the abutment plate for displacement therewith and including:

(1) a pair of vertically oriented knives (5) arranged one above the other and having edges defining a V-shaped recess, and (2) a vertically oriented guide plate (6) spaced from the recess and defining therewith a log receiving opening, whereby logs may be split by displacing the abutment plate towards the vertical and horizontal knives with the clamping member removed, or simultaneously cut and split by inserting a log to a desired length through the receiving opening of the clamping member and displacing the abutment plate and clamping member towards the vertical and horizontal knives.

* * * * *